US007195496B2

(12) United States Patent
Biermann et al.

(10) Patent No.: US 7,195,496 B2
(45) Date of Patent: Mar. 27, 2007

(54) CONNECTOR MOUNTED TO DISPLAY BOARD

(75) Inventors: Werner Biermann, Winterbach (DE); Yasar Semerci, Heilbronn (DE); Werner Deiss, Waiblingen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/270,420

(22) Filed: Nov. 9, 2005

(65) Prior Publication Data

US 2006/0073715 A1 Apr. 6, 2006

Related U.S. Application Data

(63) Continuation-in-part of application No. PCT/EP2004/004711, filed on May 4, 2004.

(30) Foreign Application Priority Data

May 5, 2003 (DE) ..... 203 06 921 U
Aug. 19, 2003 (DE) ..... 103 38 981

(51) Int. Cl.
*H01K 1/00* (2006.01)

(52) U.S. Cl. ..... 439/79

(58) Field of Classification Search ..... 439/79, 439/329, 862, 660; 361/785
See application file for complete search history.

(56) References Cited

U.S. PATENT DOCUMENTS 4,676,565 A 6/1987 Reichardt
5,383,095 A * 1/1995 Korsunsky et al. ..... 361/785
5,409,397 A 4/1995 Karman
5,915,997 A 6/1999 Lan-Jen
6,200,167 B1 * 3/2001 Aso ..... 439/660
6,315,620 B1 * 11/2001 Moir et al. ..... 439/862
2002/0004341 A1 1/2002 Hayashi et al.

FOREIGN PATENT DOCUMENTS

| | | |
|---|---|---|
| DE | 297 12 954 | 10/1997 |
| EP | 0 137 972 | 4/1985 |
| EP | 0 157 296 | 10/1985 |
| WO | WO 01/26186 | 4/2001 |

* cited by examiner

*Primary Examiner*—Alexander Gilman
(74) *Attorney, Agent, or Firm*—Peter Van Winkle

(57) ABSTRACT

A connector assembly (11) for providing electricity to an electroluminescent display (12) that is mounted on an outer face of a carrier plate (10), includes a first connector (13) that has an insulative body (21) with a rearwardly-opening slit (24) that receives an edge of the carrier plate, the body having inner and outer body arms (25, 26) on opposite sides of the slot. The first connector also has a plurality of U-shaped contact elements (28) with parallel inner and outer ends (32, 31) that lie in the different body arms. The outer end of each contact element engages a conductive pad (16) on the carrier plate but the rest of the outer end is surrounded by the outer body to safeguard against a person touching the contact element outer end. The inner end of each contact element is held spaced from the inner face of the carrier plate by the body inner arm that surrounds the inner end.

14 Claims, 5 Drawing Sheets

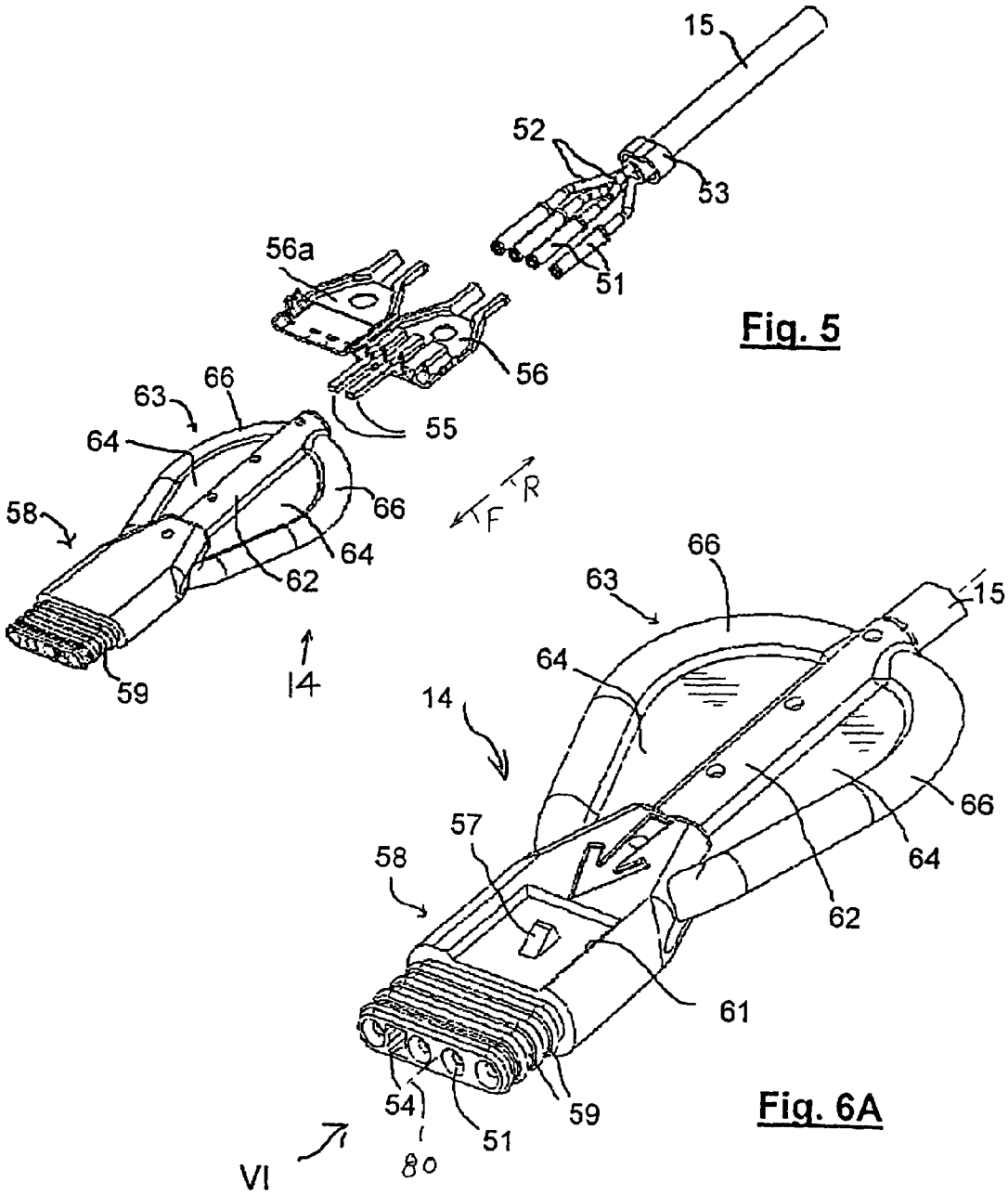
Fig. 5
Fig. 6A
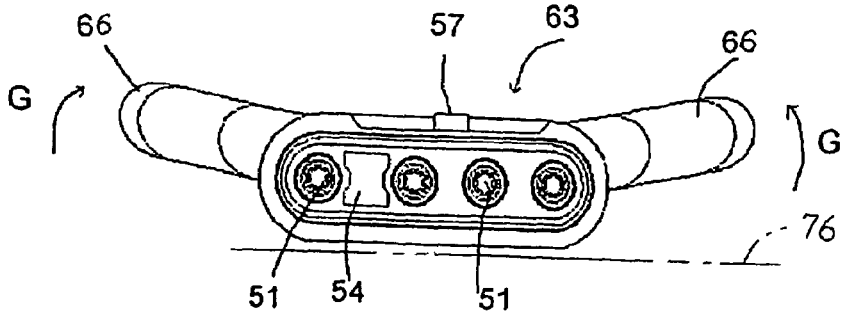
Fig. 6B

CONNECTOR MOUNTED TO DISPLAY BOARD

CROSS-REFERENCE

This is a continuation-in-part of PCT application PCT/EP2004/004711 filed May 4, 2004 which claimed priority from German application 203 06 921.8 filed May 5, 2003 and German application 103 38 981.4 filed Aug. 19, 2003.

BACKGROUND OF THE INVENTION

One type of vehicle license plate, such as shown in WO 03/062 014 A1, includes an electroluminescent display which is energized by alternating current at a potentially harmful voltage of about 140V to 200V that is derived from a much lower voltage battery and alternator. The higher voltage is high enough to harm a person who touches a conductor carrying the voltage. The display includes a thin, flat carrier plate and a thin luminous "foil" that adheres to an outer face of the carrier plate. A connector for carrying the higher voltage to the luminous foil should itself be thin and should prevent any person or object from engaging conductors that carry the higher voltage. Such protection against engagement by a person or object should remain even if the license plate that includes the carrier plate with luminous foil thereon, should not be present.

SUMMARY OF THE INVENTION

In accordance with one embodiment of the present invention, a connector assembly is provided for applying electricity to an electroluminescent display such as one used for a license plate, wherein the connector assembly is simple, of low cost, and thin, and provides a barrier against a person touching a conductor that carries electricity at a potentially harmful voltage to the display. The display includes a carrier plate with an outer face that carries a thin film or "foil" electroluminescent display, and a connector assembly includes a first connector that is mounted directly on the carrier plate. The first connector includes an insulative body with a rearwardly opening slot that receives an edge of the carrier plate, the body having inner and outer body arms that lie against inner and outer faces of the carrier plate. The first connector also includes a plurality of U-shaped contact elements that each has inner and outer ends that lie, respectively, in the inner and outer body arms. The outer end of each contact element presses directly against a contact pad formed on the outer face of the carrier plate that is connected to the electroluminescent foil. The outer end of each contact element is surrounded by the body outer arm except at the contact element inner side that engages a contact pad, to protect people against touching the contact element. The inner end of each contact element is held spaced away from the inner face of the carrier plate, by the body inner arm.

The novel features of the invention are set forth with particularity in the appended claims. The invention will be best understood from the following description when read in conjunction with the accompanying drawings.

BRIEF DESCRIPTION OF THE DRAWINGS

FIG. 5 is an exploded rear isometric view of the second connector of the connector assembly of FIG. 1.

FIG. 6A is a rear isometric view of the assembled second connector of FIG. 5.

FIG. 6B is a rear view of the connector of FIG. 6A.

DESCRIPTION OF THE PREFERRED EMBODIMENTS

1. Limited Description of the Invention

Figure 1B:
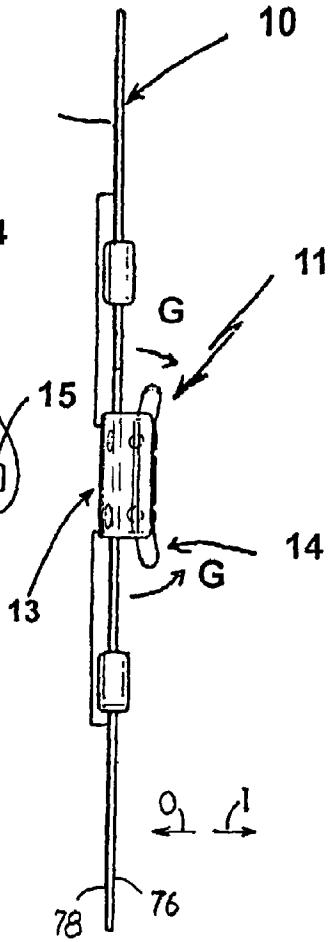
FIG. 1B is a rear view taken along arrow I of FIG. 1A.
Figure 1A:
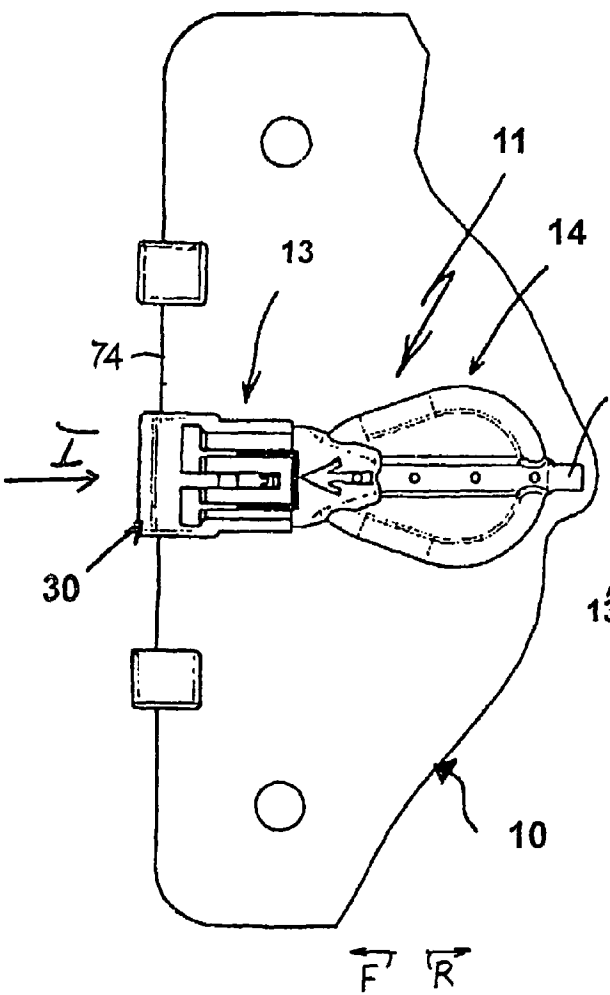
FIG. 1A is a plan view of a connector assembly of one embodiment of the invention, showing an inner side of a carrier plate of a display, with only a portion of the carrier plate shown, and without an overmold jacket shown.

FIGS. 1A and 1B show a carrier plate 10 that supports an electroluminescent display 12 that constitutes a vehicle license plate. The figures also show a connection assembly 11 that includes a first connector 13 that is mounted on a front edge portion or edge 74 of the carrier plate and display, and a second connector 14 that is mated to the first connector. The carrier and display have inner and outer faces 76, 78 that respectively face in inner I and outer O directions, and the connector assembly extends in forward and rearward longitudinal directions F, R. The display includes an electroluminescent layer or foil 12 shown in FIG. 2 that lies on the outer face of the carrier plate, and that is energized by a moderate but potentially harmful voltage such as an alternating current of 140V to 200V. An edge portion of the carrier plate contains a pair of contact pads 16 that are connected to the electroluminescent foil to supply electricity to it. The connection assembly lies primarily on the inner side of the carrier plate so that it does not block a substantial portion of the display, and the connection assembly is constructed so it adds a minimum to the thickness of the combination of the display and connector assembly. Also, the second connector 14 from which a cable 15 extends to the electricity source, should be easily disconnectable and reconnectable by a repairman. The combination of the electroluminescent layer, the carrier plate and the first connector, can be referred to as a contact assembly.

Figure 4B:
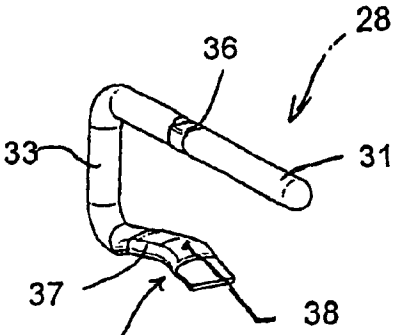
FIG. 4B is an isometric view of a contact element of the connector of FIG. 4A.
Figure 4A:
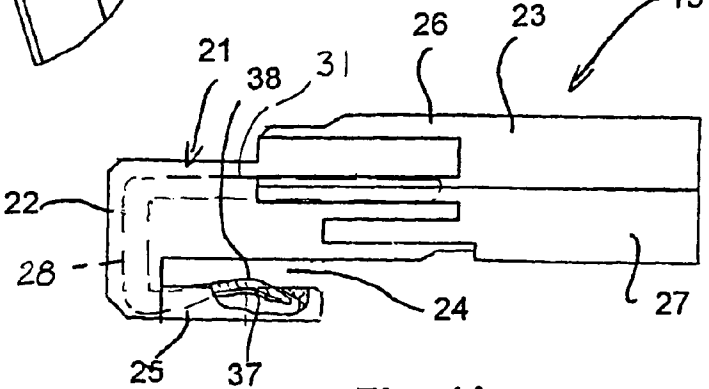
FIG. 4A is a side elevation view of the first connector of FIG. 3C.
Figure 3B:
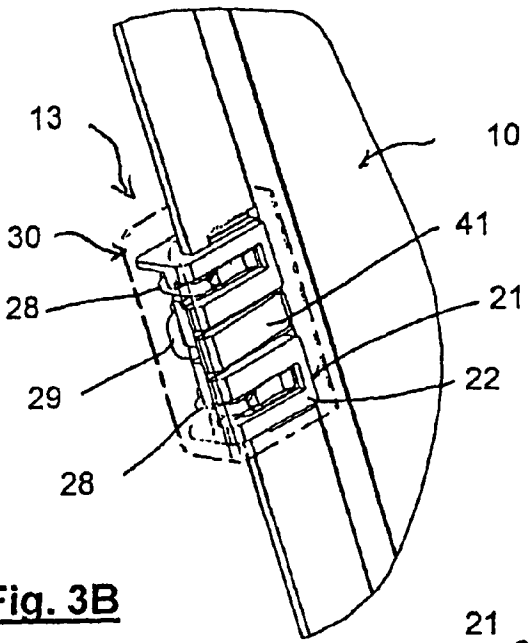
FIG. 3B is an outer and rear isometric view of the connector and portion of carrier plate shown in FIG. 3A.
Figure 3A:
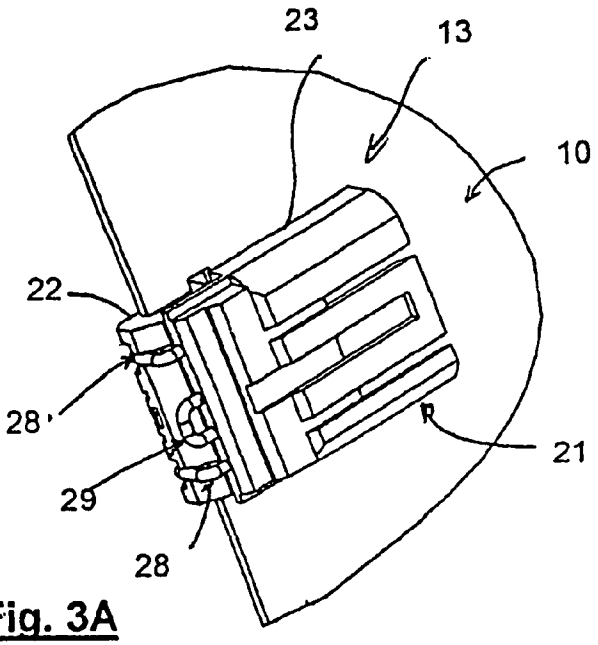
FIG. 3A is an inner and rear isometric view of a first connector of the assembly of FIG. 1 shown mounted on an edge of a carrier plate, without an overmold jacket.
Figure 3C:
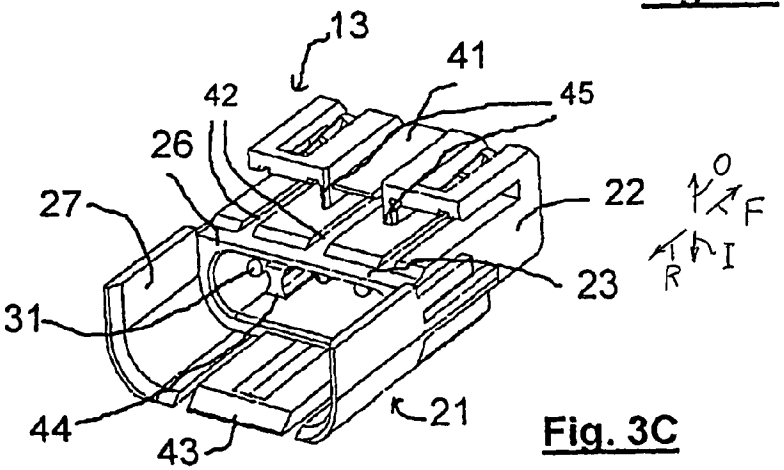
FIG. 3C is an outer and front isometric view of the connector of FIG. 3A, without the carrier plate.
Figure 7:
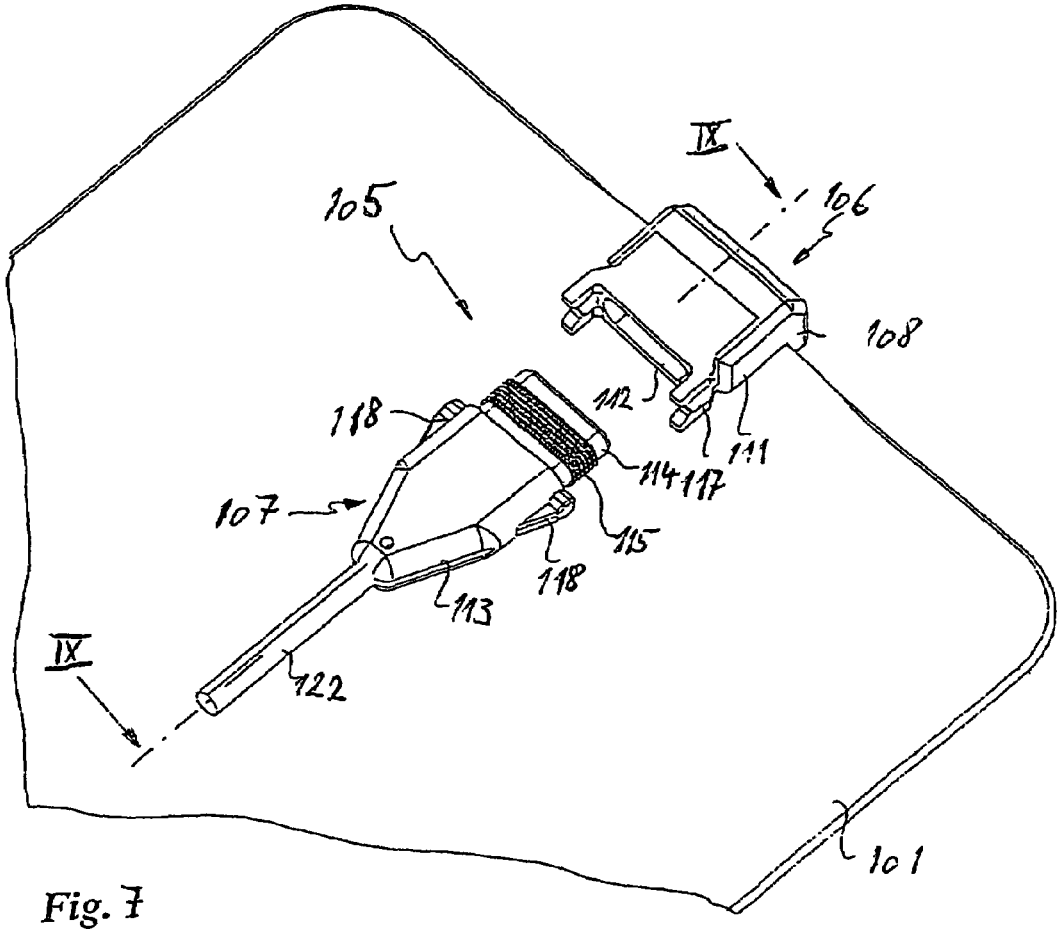
FIG. 7 is an exploded front and inner isometric view of a connector assembly of a second embodiment of the invention, with the first connector mounted on a carrier plate of an electroluminescent display.
Figure 8:
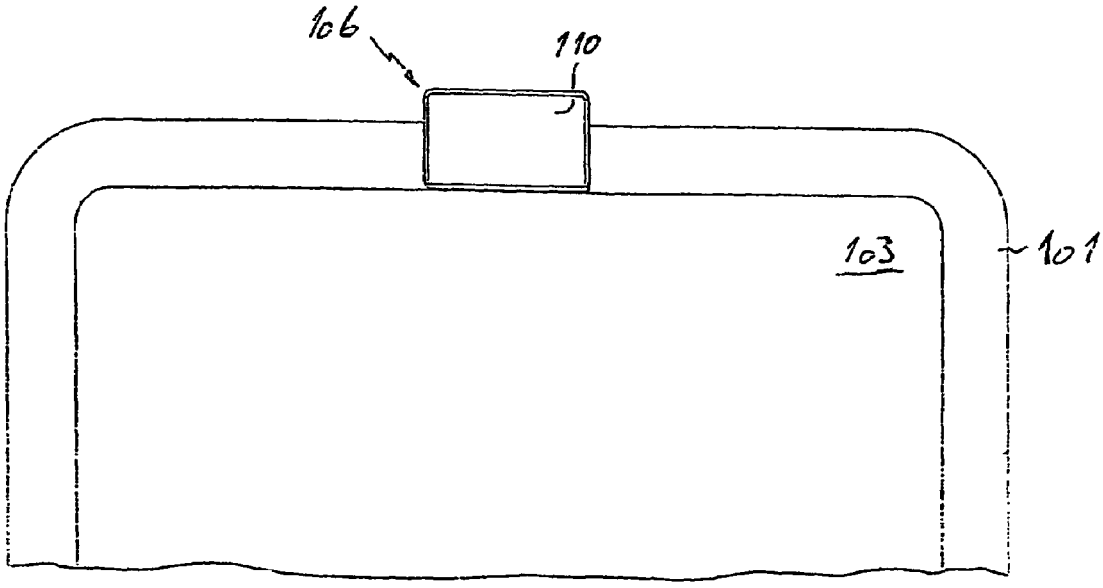
FIG. 8 is an outer elevation view of a portion of the display of FIG. 7 with the first connector mounted thereon.

FIGS. 3A, 3B, 3C, 4A and 4B show the construction of the first connector 13. FIG. 3C shows that the first connector 13 includes an insulative body 21. The body has front and rear housing parts 22, 23. The rear body part has a portion 26 that receives the mating second connector and has a guide 27 in the form of a half shell that guides the mating connector. FIG. 4A shows that the front body part has a slit 24 formed by inner and outer arms 26, 25. An edge portion of the carrier plate is received in the slit.

The first connector has a plurality of contact elements, with FIG. 4B showing the construction of each of them. Each contact element is of U-shape, with inner and outer contact ends 31, 32. The inner end 31 and a base or connecting part of the U are each of largely cylindrical shape, in that the width and thickness are about the same (neither is more than twice the other) along most of the length of each. The outer end 32 is flattened to have a width that is more than twice its thickness, with the particular outer end shown having a width that is more than four times its thickness. FIG. 4A shows that each contact 28 is positioned with a raised crown area 37 of its outer end that extends into the slit 24 that receives the carrier plate. When the first connector 13 is mounted on the carrier plate, the crown areas of a pair of contact elements each presses against one of the contact pads (16, FIG. 2) on the outer face of the carrier plate. The inner end 31 of each contact element is spaced from the slit 24 and from a carrier plate that lies in the slit. The inner end of the contact element extends into the rear housing part 23 to enable it to mate with contacts of the mating second connector. The housing, or at least its front part, are preferably molded of elastomeric material (material with a Young's modulus of elasticity of no more than 50,000 psi). The elastomeric housing material and the U-shape of the contact elements each helps keep the outer end 32 of the contact elements pressed against contact pads on the carrier plate. Applicant notes that the particular first connector of FIG. 3A also has two secondary contact elements 29 that are U shaped and connected together, with their cylindrical ends lying completely enclosed.

Figure 2:
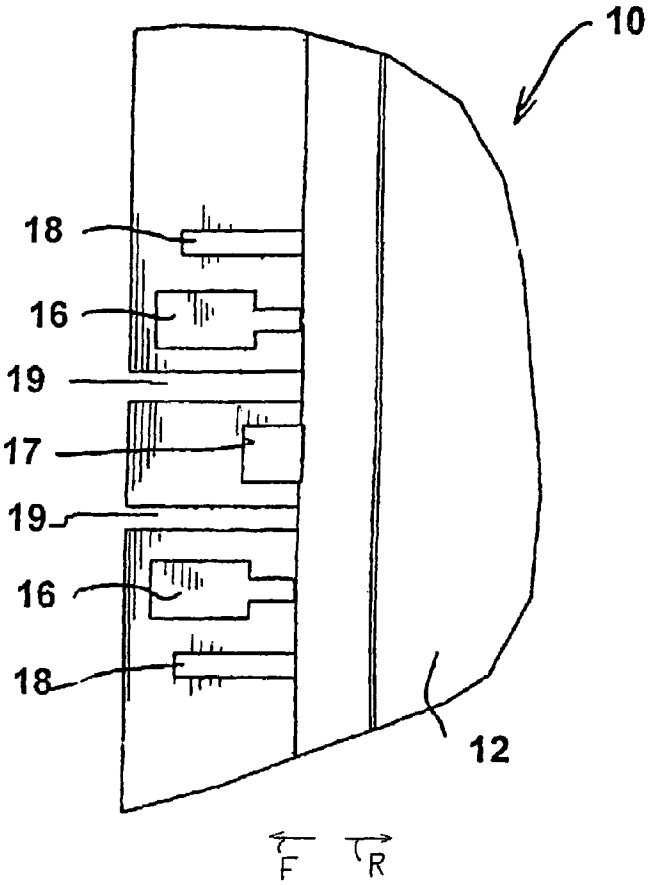
FIG. 2 is a plan view of a portion of the outer face of the display that includes the carrier plate, shown without the connectors.

FIG. 2 shows that the carrier plate has a locking cutout 17, and the first connector housing has a locking hook 41 (FIG. 3C) that lies in the cutout. The carrier plate (FIG. 2) also has a pair of cutouts 18 that receive molding material of an overmold. After the first connector is mounted on the carrier plate by sliding the first connector so its slit 24 receives the carrier plate, the first connector is overmolded with a plastic jacket indicated at 30 in FIG. 3B. The overmold jacket more securely holds the first connector housing to the carrier plate, and completely covers any part of the contact element outer ends to prevent persons or objects from engaging them and becoming shocked by the voltage.

FIGS. 5, 6A and 6B shows the second connector 14 that is mateable with the first connector 13. FIG. 5 shows that the second connector has four contacts 51 (only two are connected to contact elements that engage contact pads on the carrier plate). The contacts are connected to conductors 52 of a cable 15, with a strain relief ring 53 extending around the cable. The contacts are received in a hard insulative shell formed by two half shells 56, 56*a* that lock together. The shell is overmolded with a soft plastic housing part 58. A front area 59 of the connector surrounds the front ends of the contacts. The second housing part 58 has a recess 61 (FIG. 6A) through which a hook 57 extends. The second housing part has a bulge 62 though which the cable 15 extends, and which is part of a grip region 63. The grip region has two grips 66 that extend in loops on opposite sides of the second connector centerline 80.

As shown in FIG. 6B, the grips 66 are angled away from the inner face 76 of the carrier plate. Both grips are of elastomeric plastic and can be bent in the direction of arrows G and will return to the original positions shown when released. The grips 66 can be gripped and moved, or clamped, together to form a handle spaced from the carrier plate, to move the second connector to mate or unmate it from the first one. Afterward, the grips do not add much, if any to the thickness since they can be bent close to the carrier plate.

Figure 9:
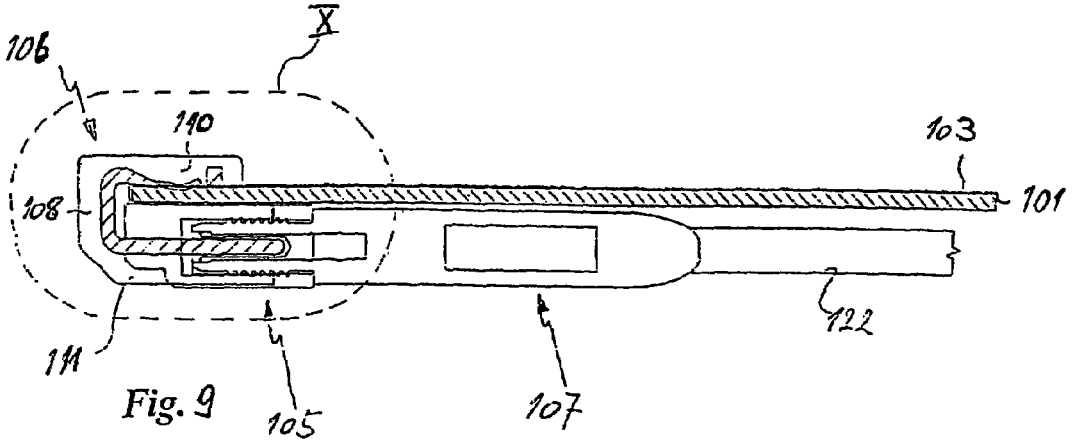
FIG. 9 is a sectional side view of the connector assembly and display taken on line IX—IX of FIG. 7, with the first and second connectors fully mated.
Figure 10:
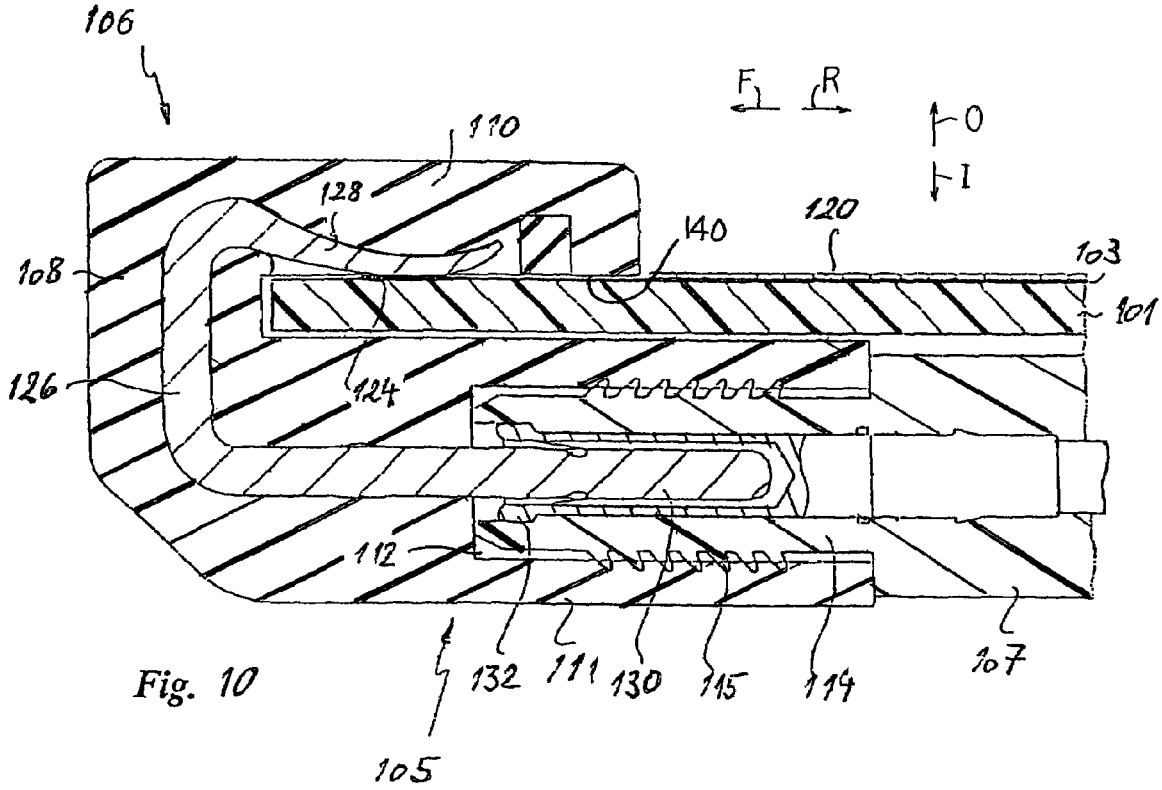
FIG. 10 is an enlarged sectional side view of a portion X of the connector assembly and display of FIG. 9.

FIGS. 7–10 show another connector system that connects to contact pads on a flat carrier plate. FIGS. 9 and 10 show a carrier plate 101 with an electroluminescent display 103. The display 103 actually includes at least four layers, and FIG. 10 shows a transparent protective layer 120 over the display 103. The display 103 is of the same construction as that of FIGS. 1–6. The connector assembly 105 shown in FIG. 7 includes first and second connectors 106, 107, with the first one 106 mounted on the carrier plate 101 and the second one 107 being mateable with the first one at the inner side of the carrier plate.

FIGS. 9 and 10 show that the first connector has an insulative body 108 that is roughly of C-shape and that forms a slit 140 that receives the carrier plate, with outer and inner arms 110, 111 of the body lying adjacent to the outer and inner faces of an edge portion of the carrier plate. The inner arm 111 has a rearwardly-facing end for receiving the second connector 107. The outer face of the carrier plate contains a pair of contact pads 124 that connect to the display. The first connector has a pair of contact elements 126 that each has an outer end 128 that engages a contact pad 124 and that has an inner end 130 that is positioned to engage a contact element of the mating second connector. The contact elements 126 are of the same shape as those of the system of FIG. 1–6, with one of the contact element being of the same shape as the one shown in FIG. 4B. The opposite ends of each contact element 126 (FIG. 10) are biased toward each other to keep the outer end 128 pressed firmly against a contact pad 124. This can be accomplished by forming the first connector body 108 of hard plastic and using the resilience of the contact elements, or by forming the first connector body of elastomeric material and using the resilience of the body to keep the contact element outer end pressed against the contact pad 126.

FIG. 10 shows that the outer arm 110 of the body extends forward of the contact element outer end 128 and protects against a person touching the contact element outer end. An elastomeric body can press its outer arm 110 firmly against the outer face of the carrier plate. The inner arm 111 forms a space or passage 112 that surrounds the inner end 130 of the contact elements. The second connector forms a socket contact element 132 that lies in a tubular second contact part 114 that fits into the first connector passage 112. The tubular part 114 has a plurality of flanges 115 that extend rearward and outward of the tubular part to form a seal against the walls of the passage 112.

2. Detailed Description of the Invention

Contact assembly 11, also termed an electrical plug-in connection device, as depicted in FIGS. 1 to 6, is designed, in accordance with FIGS. 1A and 1B, for application to a flat plate, here to a motor vehicle license plate 10, which is mounted, for example, on the rear side of a passenger vehicle or truck. Motor vehicle license plate 10 is covered on the visible surface by an electroluminescent illumination assembly, not depicted in detail, that is designated as luminous foil 12 and that is illuminated through the application of an electrical medium-voltage, for example, in the order of magnitude of between roughly 140 and 200 V of alternating current. Plug-in connection device 11 according to the present invention, which is used for this purpose, is configured such that, first of all, it can be mounted essentially on the rear side and therefore on the nonvisible side of license plate 10 so as to be flat and to occupy little space. In addition, however, plug-in connection device 11 is designed to be detachable in a simple manner, for example when the license plate is to be changed, or the like. Plug-in connection device 11 therefore is made up of a plug connector 13, which can be mounted on an edge area of license plate 10 in a mechanically locking and electrically conductive manner, and a socket connector 14, which is equipped with a connecting cable 15 and which can be detachably connected in a plug-in manner to plug connector 13 so as to be mechanically locking and electrically conductive.

According to FIGS. 3 and 4, plug connector 13 has a housing 21, which is integrally formed by a front housing part 22 for the connection to license plate 10 and a rear housing part 23 for the plug-in connection to socket connector 14. Front housing part 22, seen in a lateral view in FIG. 4, is roughly C-shaped, i.e., it has a receiving slit 24 for receiving respective edge area 19 of license plate 10. In this context, receiving slit 24 is asymmetrically arranged with respect to the transverse central axis of housing 21 and of front housing part 22, which means that upper and visible side wall 25 bordering receiving slit 24 is relatively thin.

Rear housing part 23, which when mounted on license plate 10 is exclusively arranged on the rear side of the license plate facing away from the visible side, has a plug receiving element 26, which is closed around the periphery, as well as a half-shell-like plug guide 27, which is open to the rear side of the license plate. In the receiving slit on the side that is facing away from the visible side, grooves 42 are provided that facilitate the flow of material during the subsequent injection molding. On the opposite side, guide bars 45 are provided that can be inserted into slit 19 of the motor vehicle license plate.

Housing 21 of plug connector 13 contains a plurality of contact pins 28 and 29. In the exemplary embodiment, contact pins 28 and 29 are pressed into housing 21 made of plastic, are inserted in locking fashion, or are secured in another manner. In this pre-assembled state, housing 21 is slid onto flat plate 10 (FIG. 3A) and in this position is cast or injection molded with a plastic jacket 30 that is indicated with a dot-dash line (FIG. 3B). One of two contact pins 28 is depicted in FIG. 4B. Contact pin 28 has a cylindrical, pin-shaped end 31, which is located in receiving element 26, a pressed-flat end 32, which is located in upper wall 25, i.e., in receiving slit 24, and a connecting part 33, which is arranged perpendicular thereto and which gives contact pin 28 a clamp-like appearance or that of a horizontal U. Housing 21 of plug connector 13 at both exterior side areas receives a contact pin 28. Two contact pins 29, which are U-shaped and connected to each other electrically and mechanically, are arranged in the center, their cylindrical pin-shaped ends being arranged within receiving element 26.

The upper, or visible side of motor vehicle license plate 10 according to FIG. 2, on one longitudinal end of luminous foil 12 in symmetrical arrangement with regard to its longitudinal axis, has two separate contacting areas 16, which are electrically connected to luminous foil 12. Furthermore, between two contacting areas 16 the license or license plate 10 has a locking cutout 17, into which in the plugged-in state a locking hook 41 that is arranged on plug connector housing 21 engages in accordance with FIG. 3B, as well as a further injection-molding cutout 18 for each of two contacting areas 16 on the exterior side for receiving the injection-molding mass when plug connector 13, which is locked onto plate 10, is cast for plastic jacket 30, which is designed to provide for a solid connection between plate 10 and plug connector 13 and for the electrical insulation of contact pins 28 and 29.

Contact pins 28 in order to be fixed in housing 21 have on their cylindrical end 31, for example, a flattened-out undercut location 36. Flattened end 32, which is connected to connecting part 33, has a convex curve opposite cylindrical end 31, so that a raised crown area 37 results. Crown area 37 is also curved in the transverse direction, so that a ball-shaped area results in the form of a contact point 38. As can be seen in FIG. 4A, contact pins 28 are arranged within housing 21, i.e., in the front housing part 22, such that crown area 37, or ball-shaped contact point 38, of flat contact pin end 32 protrudes from a cut in upper wall 25, into receiving slit 24. Because flat contact pin end 32 is an elastic spring, when plug connector 13 is placed onto license plate 10, a certain contact pressure results, which improves the contacting with contacting areas 16 of luminous foil 12 on license plate 10.

Therefore, in the plugged-in state, plug connector 13 presses only a little on the front, or visible side of motor vehicle license plate 10. The essential part of plug connector 13 is located on the rear side of license plate 10. Socket element guide 27 of plug connector housing 21 is open toward the rear side of license plate 10, the height of the side wall of socket element guide 27 roughly corresponding to the height, i.e. thickness, of socket receiving element 26. Socket element guide 27, in its center and in the longitudinal extension, has a locking hook 43, which, as will be described below, functions to assist in generating the locking connection with socket connector 14. Socket connector 14 itself engages in receiving element 26, an electrical contacting of each electrical contact 51, 28,29 being achieved by socket connector 14 and plug connector 13. Within receiving element 26, a protruding coding element 44 can be provided, which engages in a coding receptacle 54 on socket connector 14.

Socket connector 14 is shown in detail in FIGS. 5 and 6. In FIG. 5, socket connector 14 has, by way of example, four contact sockets or bushings 51, which at their rear end are mechanically and electrically connected in a suitable manner to cores 52 of insulated cable 15. In the area of the non-insulated end of cable 15, a ring 53 is arranged for strain relief. Contact sockets 51 with their rear end are inserted and held in a hard housing part shell, which is made up of two half shells 56, 56*a* that are provided with a film joint, for example, only on the longitudinal side, and which has corresponding locking means on the opposite side. In addition, for the effective connection to locking hook 43 (FIG. 3C) that is arranged on plug guide 27, a locking hook 57 (FIG. 6A) is injection molded onto first hard housing part shell 56. Once inserted, contacts 51 extend roughly to the end of reinforcement bars 55 that are mounted on housing shell 56. First housing part 56 is made of a hard, mechanically stable plastic. Protruding contacts 51, first housing part 56, the rest of cores 52, and a longitudinal area of non-insulated cable 15 receive an injection-molded second housing part 58, which is made of a relatively soft plastic. Second soft housing part 58 in a front area 59 surrounding protruding contacts 51 has circumferential sealing lips 59, which assure a moisture-tight connection between socket connector 14 and plug connector 13. In an adjoining area, second housing part 58 is provided with a cutout 61, through which locking hook 57 protrudes. In the adjoining area of second soft housing part 58, a bulge area 62 is visible running in the longitudinal direction, in which non-insulated cable 15 and strain relief ring 53 are held by an injection-molded part.

This bulge area 62 is part of a grip area 63 of second housing part 58. This grip area 63 also has two grip fins 64, which are arranged on both sides of bulge area 62, are rounded off on the exterior edge side, and have a thickened area 66, which terminates at the end of bulge area 62 and begins in an area behind locking hook 57. Thickened areas 66 can be thinner or they can correspond roughly to bulge area 62, the intermediate area between bulge area 62, constituting a longitudinal axis, and both exterior-edge-side thickened areas 66 of grip fins 64 having a thinner wall.

According to FIG. 6B, both grip fins 64 are arranged at an acute angle with respect to the plane of both housing parts 56 and 58, both grip fins 64 pointing in the same direction in accordance with FIG. 1B, angled away from the rear side of the license plate. Both grip fins 64, due to the relatively soft plastic of second housing part 58, can be bent and moved in the direction of arrow G, this occurring preferably so as to be capable of an elastic return. This bendability is of particular advantage when socket connector 14 in accordance with FIG. 1A is inserted into plug connector 13 and locked there. Grip area 63 is therefore essentially just as flat as plug connector 13 on the rear side of license plate 10. Because in this area on the rear side of license plate 10 there is virtually no room that would permit grip area 63 to be grasped with the fingers from above and below, i.e., parallel to license plate 10, and to take it between two opposing fingers, grip fins 64 on edge-side thickened areas 66 can be grasped and moved, i.e. bent, further in the direction of arrow G towards each other. This bending is carried out in a direction away from the rear side of license plate 10 (FIG. 1B). Once grip fins 64 have been moved towards each other, grip area 63 can be grasped in clamp-like fashion between the fingers on a surface perpendicular to the license plate. In this way, socket connector 14 can be removed without difficulty from plug connector 13.

If, in the exemplary embodiment of plug-in connection device 11, two U-shaped and two elongated contact pins 28, 29 are described, it is obvious that the number of these contact pins, arranged next to each other and parallel to license plate 10, can be modified to achieve a flat plug-in connection device 11. In addition, connector 13 can be configured as a socket, and connector 14 can be configured as a plug.

According to another exemplary embodiment, a carrier 101 is depicted, which is configured in FIGS. 7 to 10 as a flat plate, for example as a motor vehicle license plate, which on one of its planar sides supports an electroluminescent illumination assembly 103, which in the sectional view in FIGS. 9 and 10 is represented only as a single layer, although it is actually made up of at least four layers, i.e., a metallically conductive base electrode (which can be constituted by the metal plate itself), an insulation layer, a pigment layer that during operation gives off the electroluminescent light, and a transparent covering electrode that is metallically conductive and is extremely thin in comparison to the other layers. The same also applies to plate 10 in accordance with FIGS. 1 and 2.

This contact assembly 105 has two plug elements 106, 107, of which plug element 106, as can be seen specifically from FIGS. 9 and 10, has a body 108 that is roughly C-shaped, that is made of an electrically insulating material, and that can be placed onto carrier 101 and fixedly joined to it, such that with its two arms 110, 111 it encompasses one of the edges of carrier 101.

In arm 111 of body 108 of plug element 106 that is configured as the plug connector and that in the assembled state is located on the rear side of carrier 101, i.e., on the flat side opposite electroluminescent illumination assembly 103, a hollow space 112 is configured that is open to the outside, into which can be inserted a penetrating part 114 of body 113, also made of an electrically insulating material, of second plug element 107, which is configured as a socket connector. In this context, the shapes of hollow space 112 and of penetrating part 114 are adjusted to each other such that hollow space 112 in the plugged-in state is essentially filled up by penetrating part 114, a seal 115 that is provided on the exterior peripheral surface of penetrating part 114 ensuring a moisture- and dust-tight fit.

Provided on bodies 108, 113 of both plug elements 106, 107 are locking devices 117, 118, that are complementary to each other and that in the plugged-in state hold both plug elements 106, 107 in a fixed but detachable connection with each other. In this context, locking devices 118 on both longitudinal sides of plug element 107 are configured as projecting undercut fins, and locking devices 117 on plug element 106 are configured as locking clamps that flank hollow space 112 on both sides and protrude beyond it.

As can be seen in particular from FIGS. 9 and 10, electroluminescent illumination assembly 103 is covered by a transparent protective layer 120, which ensures not only moisture and dust protection for electroluminescent illumination assembly 103 but also ensures protection against contact. If carrier 101 is made of an electrically conductive material, it is covered on all sides by this protective layer 120. Contrary to what is shown in FIGS. 9 and 10, transparent protective layer 120 in the plugged-in state also encloses the open space between arms 110, 111 of plug element 106 and carrier 109, so that the electrical contacts located there, which will be explained in greater detail below, are protected against the penetration of moisture and dirt.

Connected to plug element 107 is a cable 122, whose cores (not shown) provide the current/voltage supply for electroluminescent illumination assembly 103.

Electroluminescent illumination assembly 103 can contain one or more planar capacitors, which optimally can be driven separately from each other. In the simplest case, all planar capacitors have a common base electrode and cover electrodes that are separated from each other, each of which then must be connected to its own control line to make separate operation possible. In the exemplary embodiment of contact assembly 105 described here, it is assumed that only one planar capacitor having one base electrode and one cover electrode must be provided with current or voltage, two electrically conductive connections to the assigned electronic supply circuit being sufficient. For the worker skilled in the art, it is clear that for every additional planar capacitor provided on carrier 101, at least one additional, electrically conductive connection to the electronic power supply circuit is required. These additional connections are then constructed in similar fashion to the connecting lines described below.

In order to be able to control the planar capacitor of electroluminescent illumination assembly 103, provision is made, on the front side of carrier 101, situated at the top in FIGS. 9 and 10 adjacent to electroluminescent illumination assembly 103, for two metal contact surfaces 124 that are not covered by protective layer 120 and that lie one behind the other in a direction perpendicular to the sectional plane of FIGS. 9 and 10, so that only one of them is visible, which, by way of example, is in electrically conductive connection with the base electrode (not shown) of the planar capacitor of electroluminescent illumination assembly 103, whereas the second contact surface (not shown) is connected in an electrically conductive manner to the transparent cover electrode (not shown) of the planar capacitor.

In the interior of body 108 of first plug element 106, a plurality of conductive elements are provided that are also C-shaped in the sectional view of FIGS. 9, 10, whose number is equal to the number of contact surfaces of electroluminescent illumination assembly 103. Only one of these conductive elements, which are also situated one behind the other in the direction of sight of FIGS. 9 and 10, is visible. The other conductive elements are formed in the same way.

The C-arm of conductive element 126 that is depicted on top in FIGS. 9 and 10 functions as a contact element 128 for contact surfaces 124, against which in the assembled state it is pressed by a spring action. For this purpose, either contact element 128 can be configured with respect to body 108 of plug element 106 so as to be movable in a direction perpendicular to the surface of carrier 101, or entire plug element 106 can be configured so as to be elastic. What is essential is that in the plugged-in state the lower surface of contact element 128 is pressed against contact surface 124 with sufficient pressure.

It is also important that, due to the selected arrangement, upper arm 110 of body 108 of first plug element 106 in the plugged-in state covers in a contact-proof manner both contact surfaces 124 of electroluminescent illumination assembly 103 as well as contact elements 128, so that no danger arises when the supply voltage is switched on.

The lower of the two arms of conductive element 126 is configured as a plug-in connection device 130, which in the form of a pin penetrates into hollow space 112 of lower arm 111 of plug element 106.

In the plugged-in state, a receiving, electrically conductive plug-in connection element 132, which is provided in penetrating part 114 of body 113 of plug element 107, is in highly conductive electrical contact with this penetrating plug-in connection element 130.

It is obvious that at least two receiving plug-in connection elements of this type are present, which lie one behind the other in the line of sight in FIGS. 9 and 10.

Each of receiving plug-in connection elements 132 is in electrically conductive connection with one core of cable 122 so as to make possible a current/voltage supply of electroluminescent illumination assembly 103.

The electronic supply circuit required for the operation of electroluminescent illumination assembly 103 can be situated at various locations. In this exemplary embodiment, the cores of cable 122 are connected to the outputs of this supply circuit, so that through it, plug-in connection elements 132, 130, conductive elements 126, and their upper C-arms of electroluminescent illumination assembly 103 constituting contact elements 128, the alternating-current voltage necessary for its operation is supplied that, if carrier 101 is the license plate of a motor vehicle, is derived from the onboard direct-current voltage of the motor vehicle through the electronic supply circuit.

For these variants, cable 122 and plug elements 106, 107, especially in the area of their plug-in connection elements 130, 132, must be configured such that they are suited for this alternating-current voltage in the range of 90–120 V, and also that they are protected from contact when they are separated from each other.

Alternatively, it is also possible to integrate the electronic supply circuit (not shown) into second plug element 107 such that only the onboard direct-current voltage must be supplied between the cores of cable 122 and plug-in connection elements 132 of plug element 107. This does not affect the requirements with respect to the voltage sustaining capability and the protection against contact of plug-in connection elements 130, 132.

A further possibility lies in integrating the electronic supply voltage into plug element 106. Then, in place of two through conductive elements 126, plug-in connection element 130 and contact element 128 are provided so as to be separated from each other, between which the electronic supply circuit is connected. Plug elements 130, 132 then need only be suitable for the transmission of the lower-level direct-current supply voltage. Special protection against contact of plug elements 106, 107 is then no longer necessary.

In cases in which the electronic supply circuit is integrated into one of two plug elements 106, 107, it is preferably configured as an integrated circuit, the semiconductor chip that supports it being mounted in a familiar manner on a leadframe, whose connecting legs preferably form the penetrating plug-in connection elements directly and therefore can replace contact pins 130.

If the electronic supply circuit is integrated into plug element 107 and if the connecting legs of the leadframe are designed to form the penetrating plug-in connection elements, then the receiving plug-in connection elements are provided on plug element 106.

Irrespective of the specific positioning of the electronic supply circuit, the receiving hollow space can be provided 01 plug element 107 instead of on plug element 106, in which case plug element 106 will include a corresponding penetrating part. In this event, the penetrating plug-in connection elements can be provided on plug element 107 and receiving plug-in connection elements can be provided on plug element 106.

Seal 115 can be mounted on plug element 106 instead of on plug element 107, or it can be configured so as to be an integral part of the former. It is also possible to provide seal 115 as a independent element to be manipulated separately between plug elements 106 and 107.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector assembly that includes first and second connectors, for applying electricity to a display assembly that includes a carrier plate that has outer and inner faces and that has edges including a front edge, and that includes a film-shaped display that is mounted over said outer face of said carrier plate, with at least two exposed contact pads lying on the outer surface of the carrier plate and connected to said display, said first connector having a U-shaped insulative first body that extends around said front edge of said carrier plate and that has body outer and inner arms lying respectively over the outer and inner faces of the carrier plate, said body inner arm forming a mating end that is mateable to said second connector, said first connector including a pair of first contact elements each mounted in said first body, each contact element bent into a U-shape and each having an outer end that bears against one of said contact pads, each contact element having an inner end that lies over said carrier inner face, and each contact element having a connecting part that joins said outer and inner ends, wherein:

said second connector has an insulative second body that is mateable to said first body with one body having a cavity that receives a part of the other body, and said second connector has a pair of second contact elements that each engages the inner end of one of said first contact elements;

said outer arm of said first body completely covering said contact pads and said outer ends of said first contact elements.

2. The connector assembly described in claim 1 wherein:

said inner and outer ends of each of said first contact elements extend parallel to each other and said first contact elements are each elongated so its inner and outer ends can be resiliently spread apart;

said carrier plate and first body hold said inner and outer ends of each first contact element resiliently spread apart with the outer end of each first contact element pressed tightly against one of said contact pads.

3. The connector assembly described in claim 1 wherein:

said first connector includes a plastic overmold that is molded in place around said body of said first connector, said overmold extending outward of body outer arm, to protect against a person touching said contact element outer ends.

4. A connector assembly for applying electricity to a display assembly that includes a carrier plate that has outer and inner faces and that has edges, and that includes a film-shaped display that is mounted over said outer face of said carrier plate, with at least two exposed contact pads lying on the outer surface of the carrier plate and connected to said display, including:

first and second connectors;

said first connector having an insulative first body that extends around one of said edges of said carrier plate and that has body outer and inner arms lying respectively over the outer and inner faces of the carrier plate, said body inner arm forming a mating end that is mateable to said second connector;

a pair of first contact elements each mounted in said first body, each contact element bent into a U-shape and each having an outer end that bears against one of said contact pads, an inner end that lies over said carrier inner face, and a connecting part that joins said outer and inner ends;

said second connector has an insulative second body that is mateable to said first body with one body having a cavity that receives a part of the other body, and said second connector has a pair of second contact elements that each engages the inner end of one of said first contact elements;

said outer arm of said first body completely covering said contact pads and said outer ends of said first contact elements;

said second body has a center line, a forward mating end portion, and a pair of grips lying rearward of said mating end portion, said grips being elongated in forward and rearward directions and being laterally bowed away from each other and being resiliently deflectable together and away from said carrier plate inner face and then away and towards said carrier plate inner face, to thereby facilitate gripping of the second connector to move it into and out of a mating connection with said first body inner arm.

5. The connector assembly described in claim 4 including:

a cable that has a plurality of conductors with front ends that connect to front ends of said second contact elements, said cable extending rearwardly from said mating end portion and lying between said grips.

6. A connector assembly for applying electricity to a display assembly that includes a carrier plate that has outer and inner faces and edges and a display that is mounted over said outer face of said carrier plate, with at least two exposed contact pads lying on the outer face of the carrier plate and connected to said display, including:

a first connector that has an insulative body with a rearwardly-opening slot for receiving an edge of said carrier plate, said first connector having inner and outer body arms lying inward and outward of said slot and having a front body part that connects said arms;

said first connector having a plurality of U-shaped contact elements that each has primarily parallel inner and outer ends that lie in said inner and outer body arms, and that each has a middle that lies in said front body part;

said inner body arm forming at least one passage that surrounds said contact element outer ends and that receives rear ends of said contact element outer ends and holds them spaced from said carrier plate inner face;

said body outer arm surrounds an outer side of each contact element outer end and extends rearward of the contact element outer end but does not surround an inner side of at least part of the contact outer end, to allow the inner side to engage one of said contact pads;

said body has at least a front portion that is formed of elastomeric material, and a portion of said inner arm is resiliently compressed to allow said outer ends of said contact elements to press firmly against said contact pads.

7. A connector assembly for applying electricity to a display assembly that includes a carrier plate that has outer and inner faces and edges and a display that is mounted over said outer face of said carrier plate, with at least two exposed contact pads lying on the outer face of the carrier plate and connected to said display, including:

a first connector that has an insulative body with a rearwardly-opening slot for receiving an edge of said carrier plate, said first connector having inner and outer body arms lying inward and outward of said slot and having a front body part that connects said arms;

said first connector having a plurality of U-shaped contact elements that each has primarily parallel inner and outer ends that lie in said inner and outer body arms, and that each has a middle that lies in said front body part;

said inner body arm forming at least one passage that surrounds said contact element outer ends and that receives rear ends of said contact element outer ends and holds them spaced from said carrier plate inner face;

said body outer arm surrounds a side of each contact element outer end and extends rearward of the contact element outer end but does not surround at least part of the contact outer end, to allow the contact outer end to engage one of said contact pads;

said body inner arm has walls forming a rearwardly opening passage and a first of said contact element inner ends lies in said passage; and including a second connector device that has an insulative body device and a plurality of contact devices;

said body device having a tubular part that lies in said body passage and said first of said contact devices is a socket that lies in said tubular part and in said passage and that receives and engages one of said contact elements;

said tubular part of said body device having an outside forming a plurality of flanges that engage inside walls of said rearwardly-opening passage.

8. A connector assembly for applying electricity to a display assembly, wherein the display assembly includes a carrier plate that has outer and inner faces and a display in the shape of a film that is mounted over said outer face of said carrier plate and at least two exposed contact pads lying on the outer face of the carrier plate at an edge region thereof and connected to said display, including:

first and second connectors;

said first connector including an insulative housing that forms a plate-receiving slit that receives said edge region of the carrier plate, said first connector having a rear portion lying over said carrier plate inner face and forming a rear mateable connector end that is constructed to be mateable to said second connector, said first connector having a plurality of U-shaped contact elements that extend around said slit and that each has an element outer end that lies over said carrier plate outer face and engages one of said contact pads and that each has an element inner end that lies beyond said carrier plate inner face and that is exposed and that forms part of said mateable connector end;

said rear portion of said first connector insulative housing forms a half shell (27) which surrounds an inner side of said second connector, said half shell having an open outer side that faces said carrier plate.

9. The connector assembly described in claim 8 wherein:

said carrier plate has a slot (17) and said second connector has an outer side with an outwardly-projecting finger that is received in said carrier plate slot when said first and second connectors are mated.

10. The connector assembly described in claim 8 wherein:

said carrier plate edge region has at least one plate slot (19);

said first connector includes an insulative housing that has a C-shape and that forms said slit, said housing having a plurality of housing slots and at least one bar (45) that is formed between said housing slots and that lies in said plate slot.

11. A connector assembly for applying electricity to a display assembly, wherein the display assembly includes a carrier plate that has outer and inner faces and a display in the shape of a film that is mounted over said outer face of said carrier plate and at least two exposed contact pads lying on the outer face of the carrier plate at an edge region thereof and connected to said display, including:

first and second connectors;

said first connector having a front portion with a plate-receiving slit that receives said edge region of the carrier plate, said first connector having a rear portion lying over said carrier plate inner face and forming a rear mateable connector end that is constructed to be mateable to said second connector, said first connector having a plurality of contact elements that each has an element outer end that lies over said carrier plate outer face and engages one of said contact pads and that each has an element inner end that lies beyond said carrier plate inner face and that is exposed and that forms part of said mateable connector end;

said first connector includes an insulative housing that has a C-shape and that forms said slit, and said contact elements are of U-shape and extend around said slit;

each of said contact elements has inner and outer ends lying respectively beyond said inner and outer faces of said carrier plate, and each contact element is of cylindrical cross-section along its inner end and is flattened along its outer end, with each outer end forming a contact crown (37) that engages one of said contact pads.

12. The connector assembly described in claim 10 wherein:

said crown contact is convexly rounded about two perpendicular axes.

13. The connector assembly described in claim 10 wherein:

said insulative housing has portions that lie outward, that lie on opposite sides, and that lie rearward of said contact crown.

14. A connector assembly that includes first and second connectors for applying electricity to a display assembly that includes a carrier plate that has outer and inner faces and a front edge, and a display that is mounted over said outer face of said carrier plate, with at least two exposed contact pads lying on the outer face of the carrier plate at said front edge of the carrier plate and connected to said display, said connector assembly including a first U-shaped connector mounted on said front edge of the carrier plate and having an insulative body with a rearwardly-opening slot for receiving said front edge of said carrier plate, said first connector having inner and outer body arms lying inward and outward of said slot and having a front body part that connects said arms, said first connector having a plurality of U-shaped contact elements that each has primarily parallel inner and outer ends that lie in said inner and outer body arms, and that each has a middle that lies in said front body part, with said inner contact ends being exposed to engage said contact pads of said carrier plate, wherein:

said inner body arm forms at least one rearwardly-opening passage (112) that surrounds and holds said contact element inner ends;

said second connector includes a socket element that is moveable forwardly (F) parallel to a plane of said carrier plate surfaces, into said passage to receive said contact element end and mate with it.

* * * * *